United States Patent [19]

Coski

[11] Patent Number: 5,028,092

[45] Date of Patent: Jul. 2, 1991

[54] IMPACT KERFING ROCK CUTTER AND METHOD

[75] Inventor: William D. Coski, Mercer Island, Wash.

[73] Assignee: Coski Enterprises, Ltd., Bellevue, Wash.

[21] Appl. No.: 590,556

[22] Filed: Sep. 28, 1990

Related U.S. Application Data

[63] Continuation of Ser. No. 333,556, Apr. 5, 1989, abandoned.

[51] Int. Cl.[5] ..... E21B 10/36; E21C 25/02

[52] U.S. Cl. ..... 299/10; 125/40; 173/142; 175/414; 299/69; 299/94

[58] Field of Search ..... 299/10, 26, 37, 62, 299/67, 70, 69, 94, 88; 175/414, 416, 417; 173/114, 142; 125/6, 8, 40, 41; 30/167, 167.2

[56] References Cited

U.S. PATENT DOCUMENTS

| | | | |
|---|---|---|---|
| 1,891,222 | 12/1932 | Cornett | 299/88 X |
| 1,995,062 | 3/1935 | Gray | 299/88 |
| 3,570,613 | 3/1971 | Coski | 175/374 |
| 3,589,456 | 6/1971 | McKain | 175/414 |
| 3,858,671 | 1/1975 | Kita et al. | 175/414 X |
| 4,206,947 | 6/1980 | Bingham | 299/10 |
| 4,332,420 | 6/1982 | Coski | 299/90 X |
| 4,444,434 | 4/1984 | Gurries | 299/14 |
| 4,451,093 | 5/1984 | Perez | 299/94 X |
| 4,682,819 | 7/1987 | Masse | 299/69 X |
| 4,783,123 | 11/1988 | Ottestad | 299/94 |

FOREIGN PATENT DOCUMENTS

| | | | |
|---|---|---|---|
| 2025639 | 12/1970 | Fed. Rep. of Germany | 299/69 |
| 3513821 | 11/1986 | Fed. Rep. of Germany . | |
| 8907690 | 8/1989 | PCT Int'l Appl. | 299/94 |

OTHER PUBLICATIONS

Air Goblins, Ingersoll-Rand Co., 1972 brochure.

RBH Long-Life Cutter Heads, Ingersoll-Rand, 1974 brochure.

*Primary Examiner*—Ramon S. Britts

*Assistant Examiner*—David J. Bagnell

*Attorney, Agent, or Firm*—Seed and Berry

[57] ABSTRACT

A low velocity, high mass ram is connected to the cutting tool. The cutting tool has an array of impact forward and side buttons or bars which form chip-forming spaces there between. The side buttons or bars advantageously cut a gage in the slot. A method of slot kerfing which cuts the kerf on an angle.

23 Claims, 6 Drawing Sheets

IMPACT KERFING ROCK CUTTER AND METHOD

CROSS-REFERENCE TO RELATED APPLICATION

This application is a continuation of U.S. application Ser. No. 07/333,556 filed Apr. 5, 1989, now abandoned.

DESCRIPTION

1. Field of the Invention

This invention pertains to methods and apparatus for cutting rock and earth using impact crushing of the earth and rock. More particularly, it relates to a method for angle cutting of slots with a rock drilling tool, and a reciprocating ram-type driving mechanism for that tool.

2. Description of the Prior Art

Mining tools employed for earth and rock cutting, and particularly, for tunnel boring are well known. U.S. Pat. No. 4,332,420 discloses a full bore impact tunnelling machine in which the rock and earth crushing face is designed to remove almost the full diameter of the tunnel which is being bored. This machine, however, advantageously employs a low velocity (below 20 feet per second) ram which is connected to the impact cutting tool and pulverizes the face of the formation to be bored by reciprocating the low velocity, but high mass ram and cutting tool against that face.

Percussive-type drilling machines are known in which a velocity, generally over 20 feet per second, is used to pulverize the formation to be bored. The piston in the percussive-type of drilling machine moves relative to the cutting tool or bit. The bit remains in contact with the formation and is repeatedly impacted by the high velocity reciprocating piston. These high velocity percussive drilling machines have been used to cut grooves or slots into the face of the formation to be bored rather than trying to cut large diameter holes in that formation. The slots are cut with a smaller cross-sectional area tool. After cutting several adjacent slots the machine may be directed to impact and remove the material between those slots. Problems with prior art rock and earth cutting devices are numerous. The cutting of the edge or gage of the bore has always been a problem. The location of the impact buttons or other breaking surfaces in the face of the rock drilling tool have frequently not been arranged to remove the earth and rock formation with the lowest energy level. Furthermore, the edges of the impacted formation frequently scrape the cutting side walls of the drilling tool, causing excessive wear.

SUMMARY OF THE INVENTION

This invention pertains firstly to a method of cutting slots in the rock and earth formation being bored by utilizing an angled impacting surface. The angled impacting surface cuts a slot with the cutting surfaces of the impact tool being brought against the formation at an angle to the exposed face of the formation. The angle can be defined by a plane having an inner end and an outer end. The inner end is generally to the desired depth of the slot with the outer end just beginning to enter the rock and earth formation. Next, the tool is moved along the slot to be formed, away from the inner end of the angled plane, with each impact thereafter cutting a desired chip fracture thickness at a space laterally shifted along the slot from the previous location of the inner end of the angled plane. In the preferred method, the slots are made vertically with the angled inner end of the plane being above the outer end. In this manner, broken rock and earth chips can slide by gravity out of the slot, since the angle of the plane of the cut formation will be downwardly and outward.

The tool can be held at an angle to the formation or the breaking surfaces can be formed on the front of the impact tool at an angle.

The slots formed can be at any angle to vertical and flushing fluids used to clean the broken chips from the slot.

The rock and earth cutting machine preferably includes a vehicle having a boom and an impact cutting tool on the end of the boom. A reciprocating impact drive is provided. The impact drive includes a large mass ram reciprocated by a free-floating piston.

In a preferred embodiment, the impact cutting tool is provided with a specific array of buttons. The impact cutting tool can be rectangular or square, but should have parallel side walls for cutting the sides of the slot. The forward impact face of the cutting tool is generally planar and has a plurality of spaced rows of impact front buttons. These rows are spaced from one another by chip forming spaces therebetween. The rows each have a plurality of much more closely spaced buttons. The impact cutting tool is also provided with angled impact side buttons which protrude laterally beyond the generally planar impact face and beyond the side walls of the cutting tool. These side buttons provide lateral impact loads and cut a slot wider than the side walls of the cutting tool so that the side walls of the cutting tool do not scrape against the formation. Impact bars rather than buttons may also be used.

Basically, the invention advantageously provides for the cutting of multiple slots, either vertically, horizontally or at any angle, in the face of a formation of rock and earth to be bored. The impact button or bar array alows the tool to work efficiently in these slots and to remove the chips that are broken by the tool. The impaction and removal is done with less energy. The invention is applicable not only to tunnel boring, but also to demolition, secondary breaking, shaft sinking, surface mining, and raise boring in rock, earth, concrete or other such materials. Its primary emphasis is for mining a full-faced tunnel or mine drift through this process of impacting kerfs or slots in the rock, earth, concrete, or other material to be bored.

DETAILED DESCRIPTION OF THE INVENTION

Figure 6:
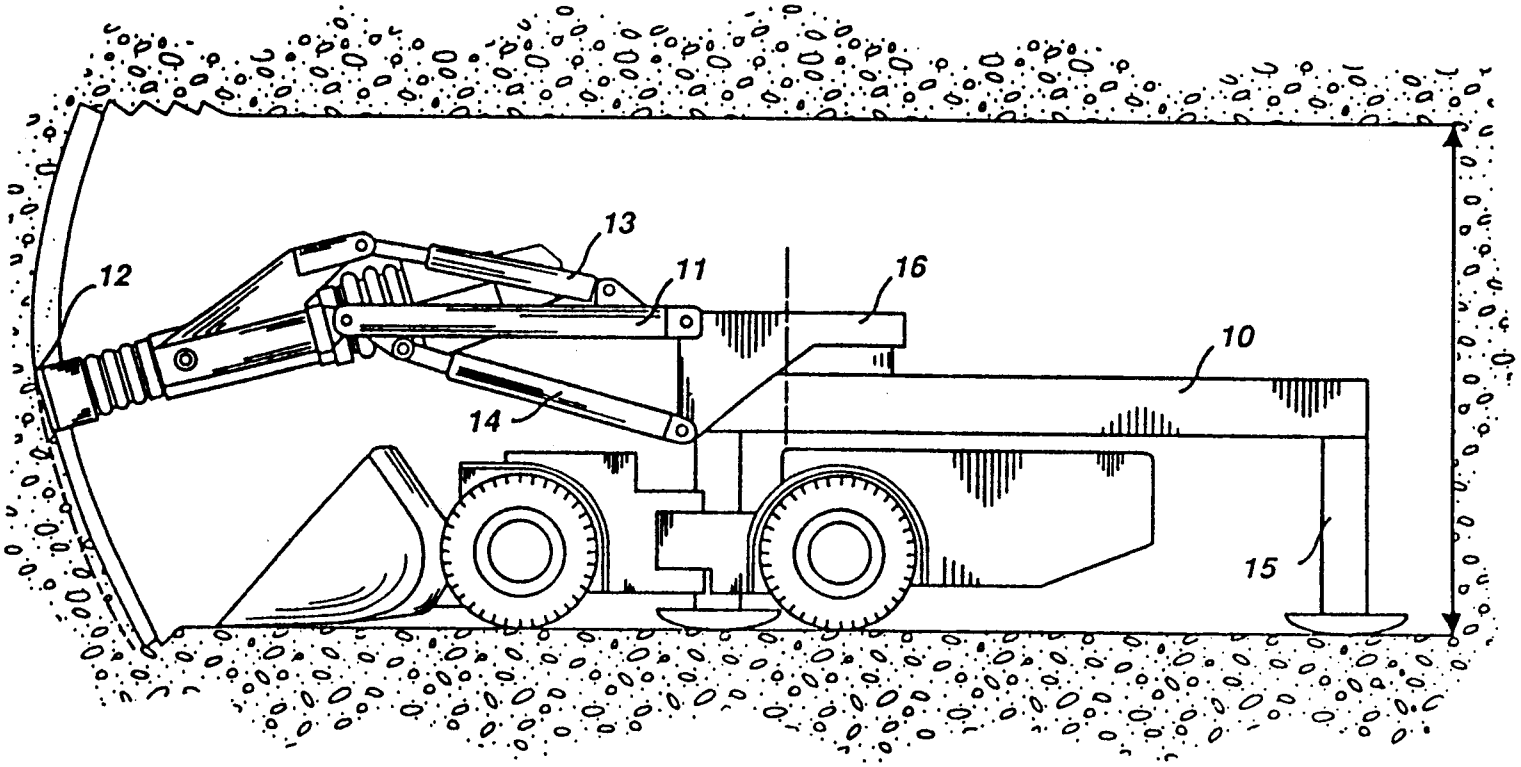
FIG. 6 is a side elevation of a rock drilling machine.

As best shown in FIG. 6, the rock and earth kerf-cutting machine includes a vehicle 10 having a boom 11. The vehicle can be self-propelled or mounted on skids 15. An impact cutting tool 12 is mounted on the end of the boom. A hydraulic cylinder and piston 13 positions the angle of the cutting tool about the boom 11. A hydraulic cylinder and piston 14 adjusts the vertical angle of the boom. Preferably, the boom is mounted on the vehicle on a rotary-powered turret 16 the details of which are not essential to an understanding of the invention. It is sufficient to understand that the boom may rotate in a horizontal plane about the vehicle 10, the boom may be elevated by the cylinder and piston 14, and the tool 12 may be pivoted about the end of the boom by the cylinder and piston 13.

Figure 7:
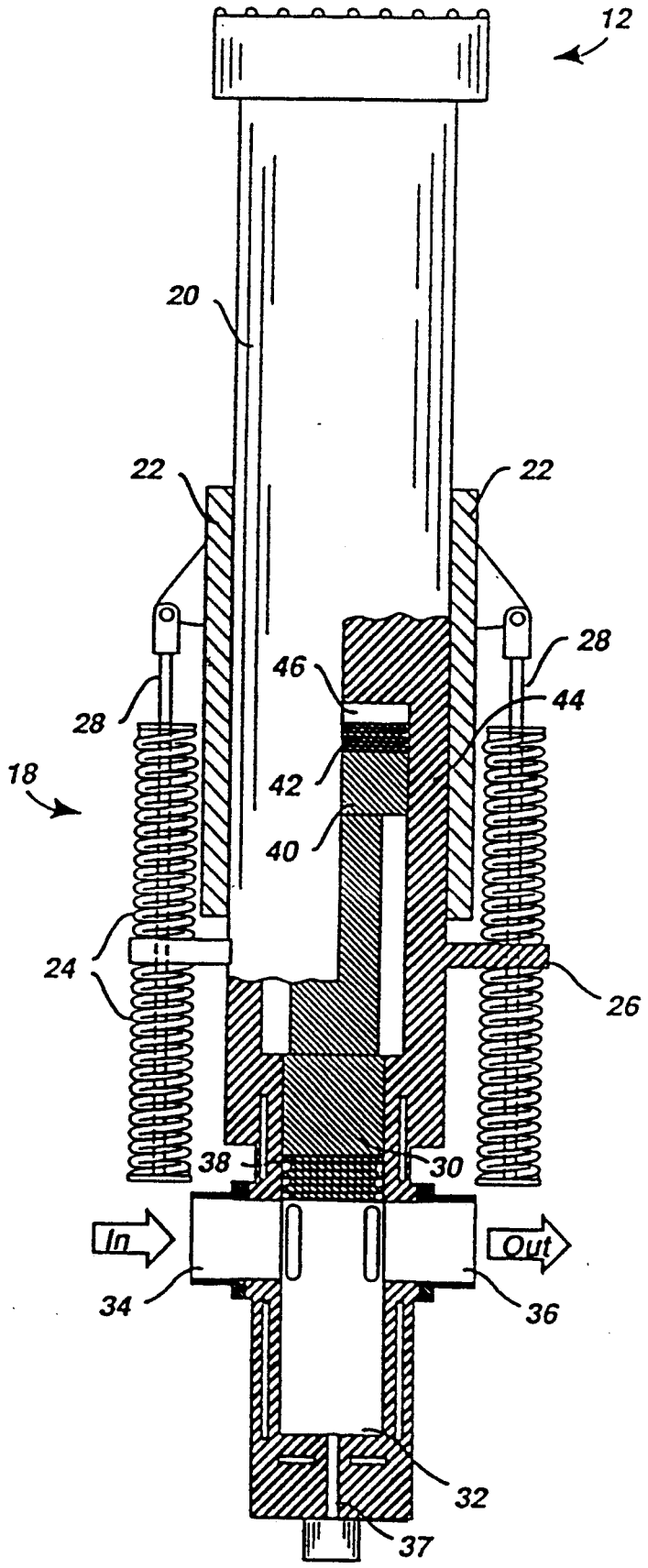
FIG. 7 is a longitudinal section of the reciprocating impact drive of the invention.

As best shown in FIG. 7, the impact cutting tool is reciprocated relative to the boom by a reciprocating impact drive 18. The impact drive includes a reciprocating hollow large mass ram 20 sliding in a carrier 22 which is connected to the boom 11 in a conventional manner. A pair of springs 24 are mounted on the carrier. The ram is provided with side flanges 26 which slide on rods 28 and compress the springs 24 when moved in either direction. Reciprocation of the ram occurs by reciprocating within the ram a free-floating piston 30. The reciprocation of the ram and the piston is also described in U.S. Pat. No. 4,332,420, the description of which is incorporated herein by reference thereto. Basically, the piston reciprocates in a combustion chamber 32 having an air inlet 34 and an exhaust 36. Fuel is introduced through an injector 37. The piston is provided with conventional compression rings 38. The opposite end of the piston is provided with a secondary piston 40 having compression rings 42. The secondary piston rides in a reciprocating chamber 44 that is connected to the ram 20. Above the secondary piston as viewed in FIG. 7 is a bounce chamber 46. The bounce chamber is sealed by the rings 42. As the piston is moved to the right by the combustion of the fuel and air in the combustion chamber 32, it compresses the air in the bounce chamber 46. This compressed air transfers motion to the ram 20 to move the ram toward the earth and rock formation. The ram moves at a relatively low velocity, less than 20 feet per second, and only about two inches until the impact cutting tool 12 impacts the formation to be cut. This transfers the energy from the high mass slow moving ram to the face of the formation driving the buttons on the face of the cutting tool into the formation. As the piston 30 travels further toward the bounce chamber, the air escapes from the exhaust and pressurized incoming air enters through the inlet 34, as in a conventional two-stroke diesel engine. The compressed air in the bounce chamber 46 then expands and drives the piston back toward the combustion chamber to compress the incoming fuel and air. The piston reciprocates in this manner, transferring its reciprocation to the ram to drive the face of the cutting tool against the formation. Movement of the piston through a 10-inch stroke, for example, produces approximately 2 inches of movement of the ram because of the ram's greater mass. As an example, the ram in one machine is approximately 3500 pounds and the piston is 700 pounds in weight.

This concept of driving the large mass ram with the cutting tool attached is contrasted with percussive drilling in which a smaller, higher velocity piston strikes the cutting tool which remains in engagement with the formation.

Figure 5:
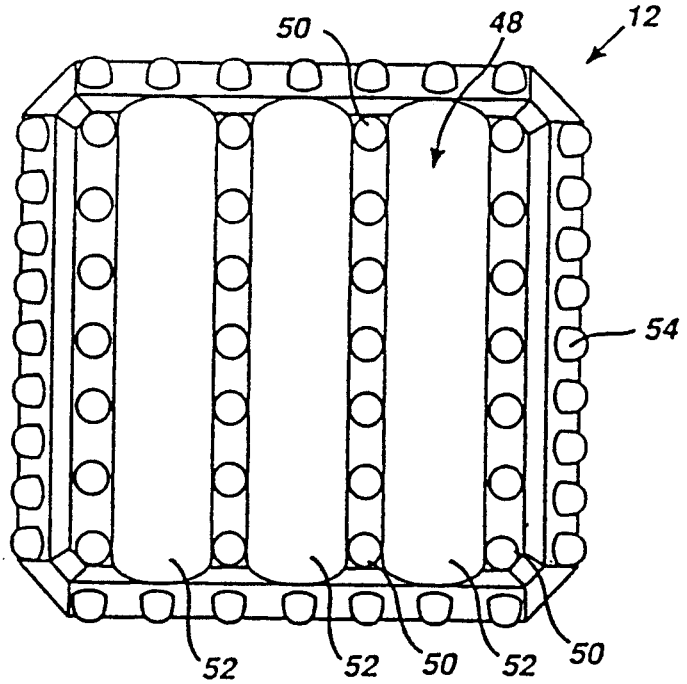
FIG. 5 is a front elevation of the impact cutting tool.

The impact cutting tool is provided with side walls 46 (FIG. 5) and a generally planar impact face 48. The side walls define a generally square impact face although the impact face could be rectangular, if desired. Mounted in the impact face using conventional impact rock-drilling techniques are rows of impact front buttons 50. These front buttons are arranged in parallel rows. Any number of straight, parallel rows can be provided depending upon the size of the impact face. The space between the rows, however, is defined as a chip-forming space 52. The buttons themselves are spaced from one another in each row by a gap much less than the chip-forming space. The spacing of the buttons and the function thereof will be described hereinafter in the specificaiton.

The impact cutting tool is also provided with a plurality of impact side buttons 54. The buttons protrude laterally beyond the generally planar impact face and beyond the side walls of the cutting tool. This additional protrusion causes the buttons to cut a slot wider than the side walls of the cutting tool so that the side walls do not rub or scrape the rock and earth formations and thus reduce wear. The impact side buttons also are offset longitudinally of the cutting tool, as shown in reference X. This rearward offsetting reduces the loading on the side buttons and transfers the load to the front buttons. This provides better distribution of wear on the buttons.

Figure 2:
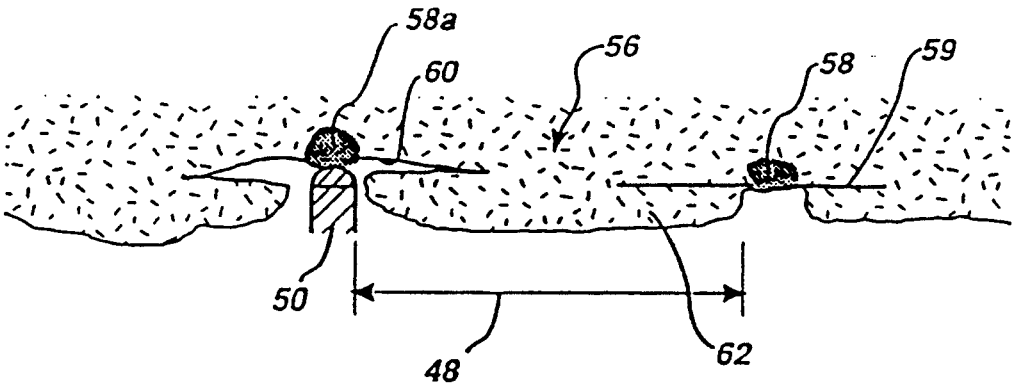
FIG. 2 is a fragmentary section at the front face of an earth and rock foundation showing two sequential impactions of the formation.

The spacing of the rows of buttons is important, as best explained by reference to FIGS. 2 and 3. FIG. 2 shows a rock and earth formation 56. The buttons 50 have impacted the space on either side of the rock chip space 52. The buttons resiliently crush the rock and earth formation as at 58. This crushing also creates a fracture line 59. The crushed formation 58 and fracture line 59 result from the first impact of a button 50. The next impact of the button 50 is shown to the left in FIG. 2. This shows the next stage of impaction of the row of buttons adjacent to the row that formed the first compressed rock 58. The button 50 to the left now crushes the rock further as shown at **58*a* opening the fracture line 59 to form a tear or slit 60. It should be understood that the diagram in FIG. 2 is intended to show an adjacent two rows of buttons with the depiction on the right in FIG. 2 showing a first impact and the depiction on the left in FIG. 2 showing the same adjacent buttons at the second impact. The second impact causes the chip 62 between the two rows of buttons to fall free leaving an exposed face along the tear line 60**. Subsequent impactions will then form newer additional rock chips until the desired depth of the slot is obtained.

Figure 3:
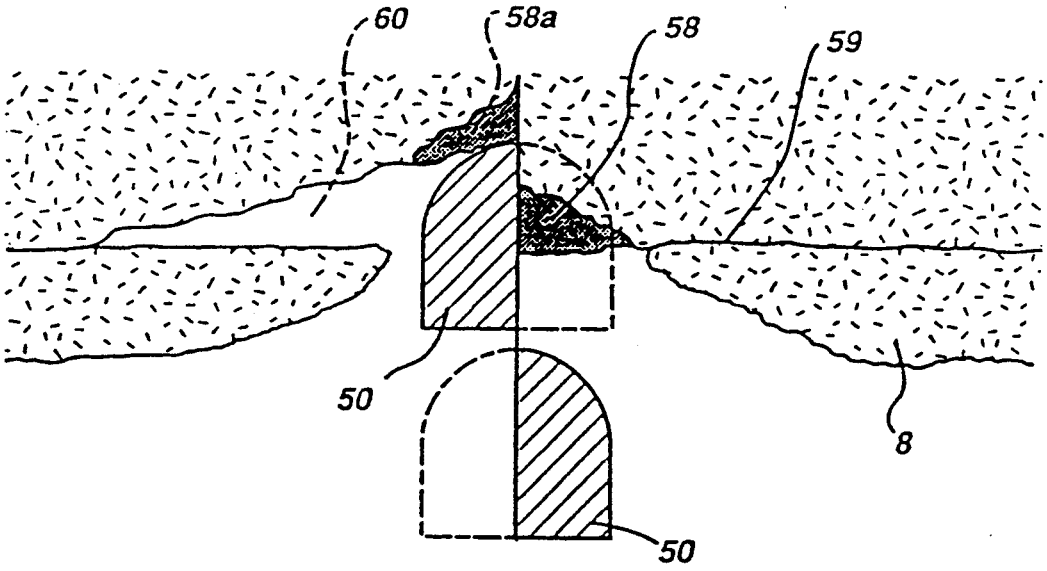
FIG. 3 is a fragmentary section similar to FIG. 2 only with larger detail of the impaction area of the formation.
Figure 4:
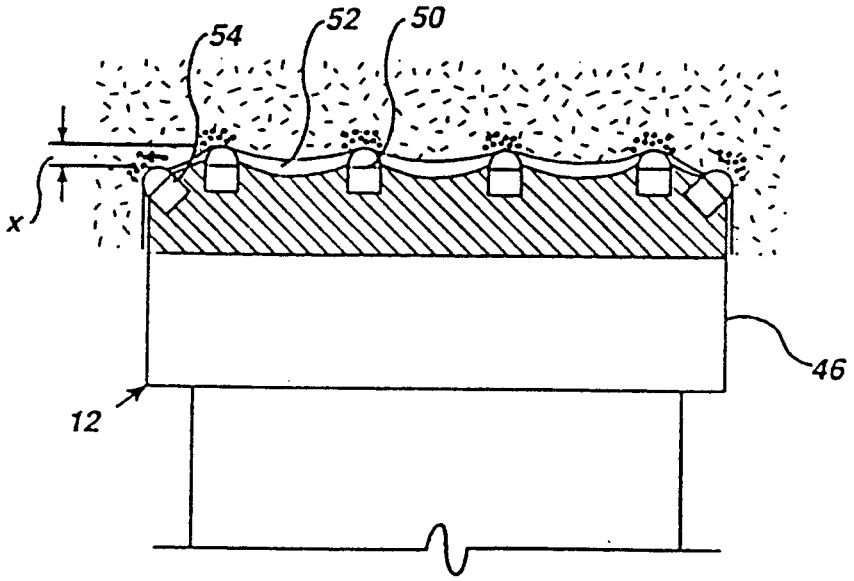
FIG. 4 is a horizontal cross section of the impact cutting tool.

FIG. 3 shows the position of a button 50 to form the first compaction 58 and the second impact with the same button which forms the second compaction **58*a*. FIG. 3 shows the one button 50** split into two halves showing the two sequential impacts creating a rock chip.

Rock chip breaking techniques have been employed before but with rotary cutting tools. An advantage of this invention, with the linear rows of buttons and a straight row of side buttons, is that the impact on the side buttons, where the rock formation is more confined and requires the greatest impact load to break the rock, is distributed along the entire row and thus reduces the wear on those side buttons. This is to be contrasted with rotary cutting tools where the outer rotary cutter must absorb all of this greater impact load resulting in excessive wear on the outer rotary cutters.

Figure 1:
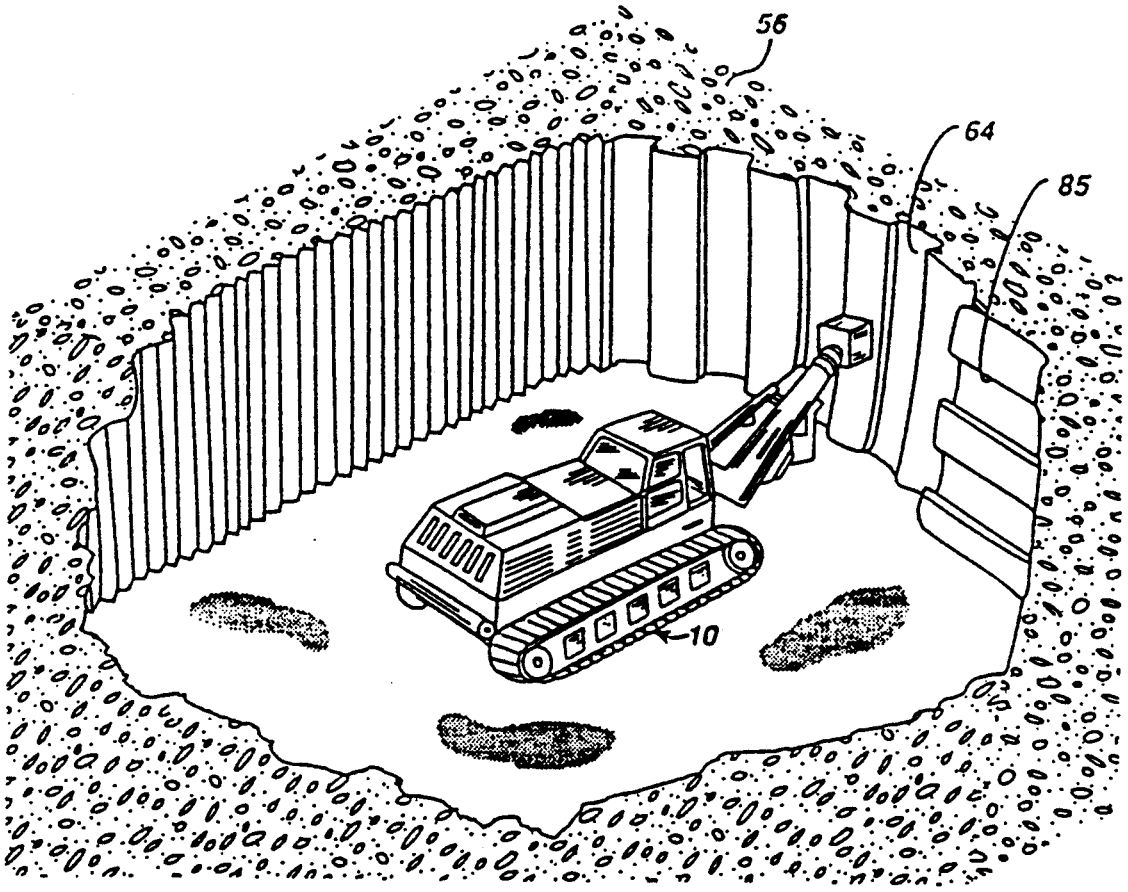
FIG. 1 is an isometric of the rock drilling machine practicing the method of this invention.
Figure 8:
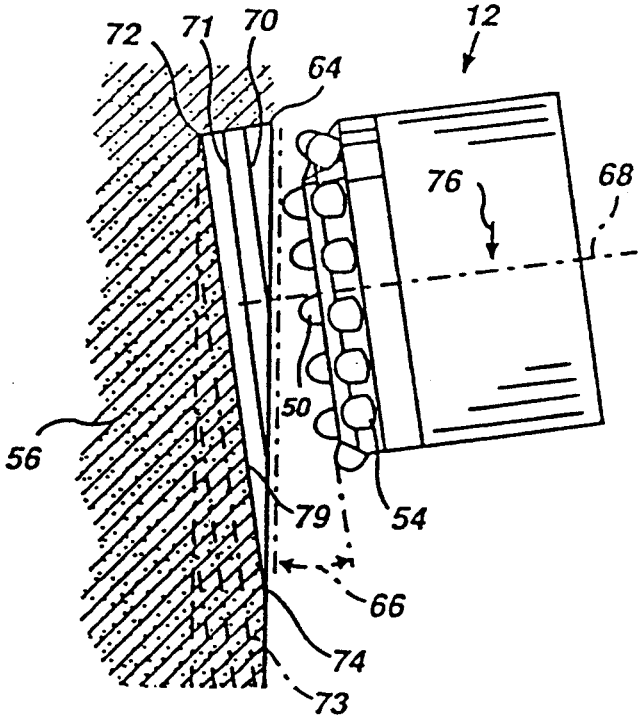
FIG. 8 is a schematic section of the rock and earth formation showing the cutting method of the invention.

A typical illustration of the slot formation in the earth and rock formation 56 is shown in FIGS. 1 and 8. FIG. 8 shows the unique angle cutting to form the slot 64. The impact tool is held by the boom at an angle to the front face of the earth and rock formation 56. This angle is best shown by the reference numeral 66. By impacting along the longitudinal center line of reciprocation 68, the buttons 50 break chips away of a thickness shown by the line 70. As the chips fall away, the buttons advance to the next line 71 and so on until they reach the innermost end of the angle of the plane of the cut best shown as 72. When the face of the impact cutting tool reaches the inner end 72 of the angle of the plane, the outer end 74 of the plane is just being reached by the buttons on the other end of the impact cutting tool. Once this desired depth of the angled cutting plane is attained, the cutting tool is shifted away from the inner end 72 of the cutting plane in the direction of the arrow 76. The cutting tool is shifted down to the phantom line 73 in one or several impacts so that the cutting tool with each subsequent impaction stroke cuts one chip formation thickness and one increment of movement along arrow 76. In this manner there exists after each impact a sloped inner earth and rock formation formed as a ramp 79. When the slot is being formed vertically as is shown in FIG. 1, this ramp allows the crushed broken chip to fall free by gravity so that no energy is lost in uselessly repetitively crushing the chips that are already broken from the formation.

Figure 9:
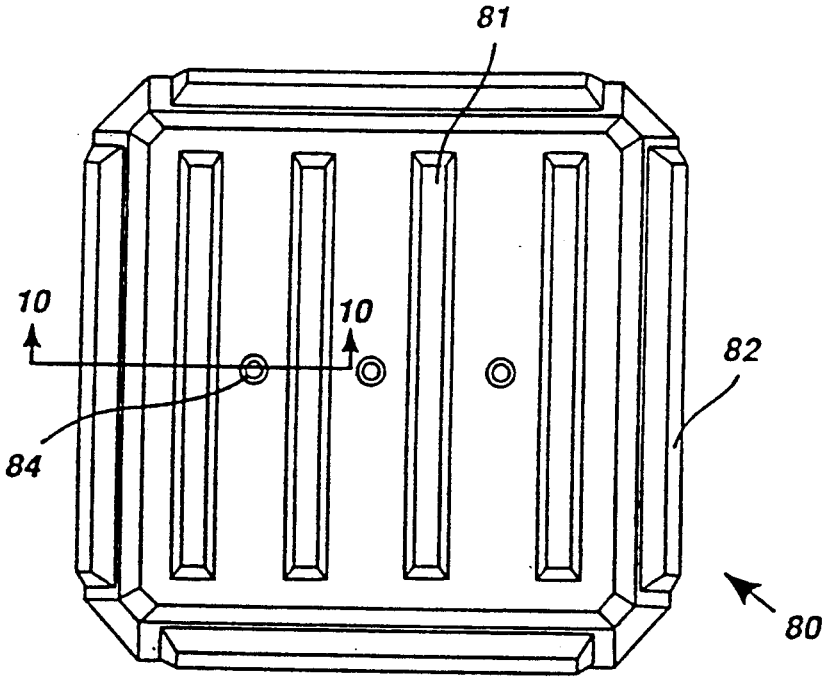
FIG. 9 is a front elevation of another embodiment of an impact cutting tool.
Figure 10:
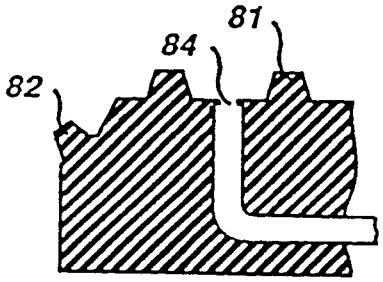
FIG. 10 is a fragmentary section taken along the line 10—10 of FIG. 9.

With reference to FIGS. 9 and 10, the impact cutting tool 80 differs from the tool 12 in that the forward portion of the tool is provided with rows of impact front bars 81 and impact side bars 82. These bars can be attached to the tool or an integral part thereof. The tool also illustrates flushing ports 84 which can be connected to a supply of liquid, air or mixture of liquid and air, for flushing broken chips out of the slot 64. The flushing capability is particularly advantageous when cutting horizontal slots 85 (FIG. 1) or slots at any other angle from vertical.

Figure 11:
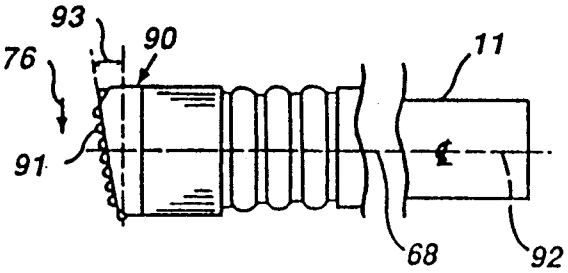
FIG. 11 is a side elevation of another embodiment of rock-drilling machine and impact cutting tool.

FIG. 11 illustrates another embodiment of rock drilling machine and impact cutting tool. In this embodiment, the impact cutting tool 90 is solid and the forward impact face 91 is shaped to a desired angle 93 to the center line 92 axis of the tool. The tool also is mounted with its center line being coincident with the center line of the boom 11. Since the impact face is already at the desired cutting angle, the cutting tool does not need to be pivoted about the boom 11, as was required in the embodiment of FIG. 6. The movement of the impact cutting tool laterally in the direction of arrow 76 to move along the slot can be done merely by shifting the tool using any conventional shifting mechanism.

The unique shape of the impact cutting tool and its array of parallel straight rows of impact front and side buttons or impact bars, the low velocity high mass reciprocating ram for providing the energy of impaction and the unique slot formation all advantageously, separately and in combination, provide a superior method of rock and earth cutting than is heretofore known. While the details of the invention have been described, it should be understood that variations will be apparent to one skilled in the art. Accordingly, the invention is not to be limited to the specific embodiment shown in the drawing.

I claim:

1. A rock and earth cutting machine having a vehicle, a boom on the vehicle, and an impact cutting tool on the boom and adapted to be reciprocated into engagement with the rock face to be impacted, a reciprocating impact drive, said impact cutting tool having a generally planar impact face, peripheral side walls, and a central longitudinal axis perpendicular to said generally planar impact face, said impact drive reciprocating along said impact cutting tool central longitudinal axis, a plurality of impact front breaking surfaces protruding from said impact face, said impact cutting tool having a plurality of impact side breaking surfaces protruding at an angle to said impact face and extending laterally of said impact face and beyond said cutting tool side wall for cutting a kerf width wider that said cutting tool side wall to provide clearance between the cutting tool and the side of the kerf being cut, and said cutting tool having four side walls, said side breaking surfaces protruding beyond all four side walls.

2. The rock and earth cutting machine of claim 1, said front breaking surfaces being arranged in parallel straight rows having chip-forming spaces therebetween.

3. The rock and earth cutting machine of claim 2 wherein said breaking surfaces are separate buttons, said rows of front buttons each having a plurality of buttons spaced more closely than said chip-forming spaces.

4. The rock and earth cutting machine of claim 1 wherein the breaking surfaces are elongated bars.

5. The rock and earth cutting machine of claim 4 wherein the bars are integral with the impact cutting tool.

6. A method of cutting a slot in a rock, earth or other hard formation comprising reciprocating an impact tool against the formation in repeated impact strokes into and out of engagement with the formation and at an angle to the exposed face of the formation, the angle defined by a fracture plane having an inner end and an outer end, repeating said impaction until the fracture plane inner end has reached a desired slot depth, repeating the impaction after shifting the impact tool along the slot and in a direction away from the angled inner end of the fracture plane in the formation to form an elongated slot from repeated impaction and shifting of the impact tool.

7. The method of claim 6 wherein said slot is cut generally horizontally, and including the step of flushing the slot to remove broken chips.

8. A method of cutting a slot in a rock, earth or other hard formation comprising impacting an impact tool against the formation at an angle to the exposed face of the formation, the angle defined by a fracture plane having an inner end and an outer end, repeating said impaction until the fracture plane inner end has reached a desired slot depth, repeating the impaction after shifting the impact tool along the slot and in a direction away from the angled inner end of the fracture plane in the formation to form an elongated slot from repeated impaction and shifting of the impact tool, and impact tool having a forward generally planar impact face, a plurality of impact front breaking surfaces on the impact face, a plurality of impact side breaking surfaces protruding at an angle to said planar impact face and beyond the side periphery of the impact face, the step of reciprocating the impact tool against said formation including impacting the formation with side breaking surfaces to clear a gage in the elongated slot for said impact tool of a width greater than the width of the impact tool.

9. The method of claim 8, wherein the slot is cut generally vertically, said inner end of the angle of the fracture plane being above the outer end so that the fracture plane forms a ramp to allow broken chips to fall by gravity out of the slot.

10. An impact cutting tool for a reciprocating impact rock and earth cutting machine, comprising peripheral side walls and a forward generally planar impact face, a plurality of straight parallel rows of impact front breaking means protruding from said impact face, said rows spaced from one another by a chip-forming space, said breaking means being rows of spaced buttons, said rows each having a plurality of buttons spaced more closely than said chip-forming space between rows, including impact side buttons being at an angle to said front buttons and extending laterally outwardly beyond a peripheral side wall of said cutting tool.

11. The impact cutting tool of claim 10, said side buttons being positioned along all sides of said cutting tool.

12. An impact cutting tool for a reciprocating impact rock and earth cutting machine, comprising peripheral side walls and a forward generally planar impact face, a plurality of straight parallel rows of impact front breaking surfaces protruding from said impact face, said rows spaced from one another by a chip-forming space, and said breaking surfaces are in a plane that is at an angle to the center line of the tool for cutting an angled slot while the center line of the tool is perpendicular to the face of the formation.

13. The impact cutting tool for a reciprocating impact rock and earth cutting machine, comprising peripheral side walls and a forward generally planar impact face, a plurality of straight parallel rows of impact front breaking surfaces protruding from said impact face, said rows spaced from one another by a chip-forming space, and said impact face being rectangular, including impact side breaking surfaces protruding at an angle to said impact front breaking means and longitudinally offset rearwardly of said impact front breaking means for distributing the impact load more uniformly between the front and side breaking surfaces.

14. A method of cutting a kerf in a rock, earth, or other hard formation using a rectangular-shaped impact tool on a reciprocating structure for reciprocating the impact tool into and out of engagement with the formation with each stroke to provide impact crushing of the formation, the steps comprising reciprocally crushing formations at a first location with a reciprocating impact tool having spaced rows of impact surfaces for breaking the formations in separated rows, sufficiently deforming the formations impacted by the impact surfaces on said impact tool to put an area between the rows in front of said impact tool under stress sufficient to break away the area so stressed from the formation without being impacted directly by the impact surfaces, shifting the cutting tool in the direction of the length of the rows to a second location, crushing the formations in the rows in front of the shifted cutting tool at said second location spaced from the first location, but in the same rows, and repeating reciprocating at further locations along the rows without substantially impacting the area between the rows so that large chips of the formation impacted form between the rows and are broken by the stresses in the area between the rows caused by the crushing in the rows.

15. The method of claim 14 wherein the rows are vertical and are spaced horizontally.

16. The method of claim 14 wherein the rows are horizontal and are spaced vertically.

17. A method of cutting a kerf in a rock, earth or other hard formation, the steps comprising crushing rock at a first location in separated rows, deforming the rock to put an area between the rows under stress, crushing the rock in the rows at a second location spaced from the first location, but in the same rows, and repeating the crushing at further locations along the rows without substantially impacting the rock between the rows so that large chips of rock form between the rows and are broken by the stresses in the rock between the rows caused by the crushing in the rows, the steps of crushing the rock performed using an impact tool having an impact face, peripheral side walls, and front breaking surfaces protruding from the impact face, said front breaking surfaces being positioned to correspond to the rows being crushed, said impact face having spaces between the front breaking surfaces wide enough to allow the formation of the large chips of rock.

18. The method of claim 17 wherein the impact tool used to crush the rock further includes side breaking surfaces protruding at an angle to the impact face, said side breaking surfaces extending laterally of the impact face and beyond the peripheral side walls of the impact tool for cutting a kerf width wider than the peripheral side walls of the cutting tool.

19. The method of claim 18 wherein the impact face is rectangular.

20. An impact cutting tool for a reciprocating impact rock and earth cutting machine, comprising rectangular peripheral side walls and a forward generally planar impact face having opposite ends joining a center, impact breaking means protruding from said face, said breaking means arranged in straight elongated non-intersecting rows parallel to each other and to the rectangular side walls of the cutting tool, each breaking means row distributed across the entire planar impact face from adjacent one side wall to adjacent the opposite side wall including the center and ends of the planar impact face, and rows each spaced from one another by an elongated chip-forming space, said impact cutting tool having a plurality of impact side breaking means protruding at an angle to said impact face and extending laterally of said impact face and beyond said cutting tool side wall for cutting a kerf width wider than said cutting tool side wall to provide clearance between the cutting tool and the side of the kerf being cut, whereby the rows of breaking means break the rock and earth generally uniformly on opposite sides of the chip-forming spaces substantially the entire length of the planar impact face.

21. The impact cutting tool of claim 20, said breaking means being rows of spaced buttons, said rows each having a plurality of buttons spaced more closely than said chip-forming space between rows.

22. The impact cutting tool of claim 21 wherein said breaking means are elongated solid protruding surfaces integral with the cutting tool.

23. The impact cutting tool of claim 21 wherein said breaking means are elongated bars.

* * * * *